US005358278A

United States Patent [19]

Ellis

[11] Patent Number: 5,358,278

[45] Date of Patent: Oct. 25, 1994

[54] POCKET-SIZE PERSONAL FINANCIAL ORGANIZER

[76] Inventor: Dennis J. Ellis, 2510 Creekwood Dr., Dothan, Ala. 36301

[21] Appl. No.: 174,803

[22] Filed: Dec. 29, 1993

[51] Int. Cl.[5] ..... B42D 1/00

[52] U.S. Cl. ..... 281/31; 281/29; 402/79; 402/73

[58] Field of Search ..... 281/31, 29, 21.1, 38; 402/79, 70, 73

[56] References Cited

U.S. PATENT DOCUMENTS

| | | | |
|---|---|---|---|
| 440,783 | 8/1890 | Wells . | |
| 451,135 | 1/1890 | Rueger . | |
| 1,592,505 | 10/1926 | Richie . | |
| 1,596,201 | 8/1923 | Marsh . | |
| 1,664,897 | 5/1926 | Pilbrow . | |
| 1,695,315 | 6/1926 | Berns . | |
| 1,829,282 | 7/1929 | Irwin . | |
| 4,400,016 | 8/1983 | Tippets . | |
| 4,400,017 | 8/1983 | Pendergrass . | |
| 4,489,958 | 12/1984 | Pendergrass . | |
| 4,689,018 | 8/1987 | Trinity . | |
| 4,890,728 | 1/1990 | Grimsley | 281/31 X |
| 4,964,656 | 10/1990 | Prentice | 281/31 X |
| 5,114,009 | 5/1992 | Johnston | 281/31 X |
| 5,277,451 | 1/1994 | Ganza | 281/31 X |

*Primary Examiner*—Willmon Fridie
*Attorney, Agent, or Firm*—Gerald M. Walsh

[57] ABSTRACT

A pocket-size personal financial organizer for monitoring, controlling and reducing spending. The organizer provides means for projecting spending in various categories by month and by week, recording daily, weekly, and monthly spending by category, determining spending differentials between projected and actual spending, determining monthly net cash flow, determining how much money to set aside for future spending, recording debt payments, and recording tax deductible spending. Analytical means for determining spending differentials and net cash flow provides necessary financial information for adjusting projected and actual spending to maintain positive spending differentials and net cash flow. The invention further provides means for calculating six month summaries of actual spending relative to income. The invention is contained within a convenient portable booklet and can be used up to twelve months.

1 Claim, 12 Drawing Sheets

CATEGORY DESCRIPTIONS

| HOUSING CHILD CARE | FOOD | TRANSPORTATION | CLOTHING PERSONAL CARE |
|---|---|---|---|
| MORTGAGE/RENT | GROCERIES | CAR PAYMENTS | CLOTHES & ACCESSORIES |
| 2ND & 3RD MORTGAGE PAYMENT | EATING OUT | AUTO INSURANCE | LAUNDRY & DRY CLEANING |
| CHILD CARE | SNACKS | GAS & OIL | REPAIRS & ALTERATIONS |
| HOMEOWNER INSURANCE | WORK LUNCHES | LICENSES, FEES & TAXES | GROOMING AIDS & MAKE-UP |
| PROPERTY TAX | CREDIT CARD PAYMENTS | PARKING & GARAGE RENTAL | BARBER/BEAUTY SHOP |
| UTILITIES | | MAINTENANCE & REPAIRS | TOILETRIES |
| HOUSEHOLD SUPPLIES | | PUBLIC TRANSPORTATION | PERSONAL MAINTENANCE |
| CABLE TV/TELEPHONE | | COMMUTING FARES | HUSBAND ALLOWANCES |
| HOUSE MAINTENANCE/REPAIRS | | CAR WASHING | WIFE ALLOWANCES |
| PEST CONTROL/YARD CARE | | SAVINGS FOR REPAIRS & | CHILDREN ALLOWANCES |
| SAVINGS FOR REPAIRS & | | MAINTENANCE | SAVINGS FOR CLOTHES |
| MAINTENANCE | | CREDIT CARDS/INSTALLMENT | CREDIT CARDS/INSTALLMENT |
| CREDIT CARDS/INSTALLMENT | | LOAN PAYMENTS | LOAN PAYMENTS |
| LOAN PAYMENTS | | | |
| | | | |

| SAVINGS RETIREMENT | MEDICAL LIFE INSURANCE | RECREATION EDUCATION | CONTRIBUTIONS MISC |
|---|---|---|---|
| EMERGENCY FUNDS | HEATH INSURANCE PREMIUM | SAVINGS FOR VACATION | CHURCH/SYNAGOGUE |
| (3-12 MONTHS NET PAY) | LIFE INSURANCE PREMIUM | ENTERTAINMENT/MOVIES/PLAYS | CHARITY |
| FINANCIAL GOALS | DISABILITY INSURANCE | SPORTS EVENTS/EQUIPMENT | POLITICAL |
| RETIREMENT | MEDICATION | EXTRA FOOD | TOBACCO/ALCOHOL |
| INVESTMENTS | DOCTOR/DENTAL FEES | HOBBIES | GAMBLING |
| STARTING A BUSINESS | MEDICAL ITEMS & SUPPLIES | TUITION/BOOKS | PRESENTS/GIFTS |
| | SAVINGS FOR MEDICAL | ROOM & BOARD | BANK SERVICE CHARGE |
| | EMERGENCIES | EDUCATIONAL SUPPLIES | CREDIT CARD PAYMENTS |
| | HOSPITAL BILLS | COLLEGE FUND | |
| | CREDIT CARD PAYMENTS | SELF IMPROVEMENT | |
| | | BOOKS/PAPER & MAGAZINES | |
| | | MEMBERSHIP DUES | |
| | | CREDIT CARD PAYMENTS | |
| | | | |
| | | | |
| | | | |

TRAC-A-SPENDING-PLAN™ WORKSHEET

| SOURCE OF INCOME | | | | |
|---|---|---|---|---|
| INCOME DEDUCTIONS | INCOME | INTEREST INCOME | MISCELLANEOUS INCOME | TOTALS |
| MONTHLY GROSS INCOME | | | | |
| LESS TITHES (10% OF GROSS INCOME) | | | | |
| LESS WITHHOLDING TAXES (FEDERAL, STATE, LOCAL, FICA) | | | | |
| **MONTHLY NET INCOME** | | | | |

FIGURE 6

TRAC-A-SPENDING-PLAN™ WORKSHEET

MONTHLY PROJECTED SPENDING

| MONTHLY PROJECTIONS | |
|---|---|
| HOUSING/CHILD CARE | |
| FOOD | |
| TRANSPORTATION | |
| CLOTHING/PERSONAL CARE | |
| SAVINGS/RETIREMENT | |
| MEDICAL/LIFE INSURANCE | |
| RECREATION/EDUCATION | |
| CONTRIBUTIONS/MISC. | |
| COMBINED PROJECTED SPENDING | |
| NET INCOME | |

| HOUSING/CHILD CARE | |
|---|---|
| RENT OR MORTGAGE | |
| 2ND & 3RD MORTGAGE | |
| CHILD CARE EXPENSES | |
| CHILD SUPPORT | |
| ALIMONY | |
| UTILITIES | |
| CABLE TV/TELEPHONE | |
| HOUSEHOLD SUPPLIES | |
| SERVICES (YARD CARE, ETC.) | |
| SAVINGS FOR PROPERTY TAX | |
| SAVINGS FOR REPAIRS/ MAINTENANCE | |
| INSTALLMENT PAYMENT FOR HOUSING TYPE ITEMS | |
| OTHER | |
| TOTAL | |

| FOOD | |
|---|---|
| GROCERIES | |
| MEALS (DINING OUT) | |
| MEALS (SNACKS) | |
| WORK LUNCHES | |
| SCHOOL LUNCHES | |
| CREDIT CARD PAYMENT | |
| OTHER | |
| OTHER | |
| OTHER | |
| TOTAL | |

| TRANSPORTATION | |
|---|---|
| AUTOMOBILE PAYMENT | |
| AUTO INSURANCE | |
| GAS & OIL | |
| CAR WASHING/MAINTENANCE | |
| PUBLIC TRANSPORTATION | |
| COMMUTING FARE | |
| PARKING/GARAGE RENTAL | |
| SAVINGS FOR REPAIRS/ MAINTENANCE | |
| SAVINGS FOR LICENSE FEES/TAXES | |
| SAVINGS FOR AUTO INS. | |
| CREDIT CARD PAYMENT | |
| OTHER | |
| OTHER | |
| OTHER | |
| TOTAL | |

| CLOTHING/PERSONAL CARE | |
|---|---|
| CLOTHES & ACCESSORIES | |
| LAUNDRY & DRY CLEANING | |
| GROOMING AIDS | |
| HUSBAND ALLOWANCES | |
| WIFE ALLOWANCES | |
| CHILDREN ALLOWANCES | |
| BARBER SHOP | |
| BEAUTY PARLOR | |
| SAVINGS FOR CLOTHES | |
| CREDIT CARD PAYMENT | |
| OTHER | |
| OTHER | |
| OTHER | |
| TOTAL | |

| SAVINGS/RETIREMENT | |
|---|---|
| EMERGENCY FUNDS (3-12 MONTH'S NET PAY) | |
| RETIREMENT | |
| FINANCIAL GOALS | |
| INVESTMENTS | |
| STARTING A BUSINESS | |
| OTHER | |
| OTHER | |
| OTHER | |
| TOTAL | |

| MEDICAL/LIFE INSURANCE | |
|---|---|
| HEALTH INS. PREMIUM | |
| LIFE INS. PREMIUM | |
| HOSPITALIZATION INS. | |
| DISABILITY INS. | |
| DOCTOR & DENTAL FEES | |
| HOSPITAL BILLS | |
| PRESCRIPTION DRUGS | |
| MEDICAL ITEMS/SUPPLIES | |
| SAVINGS FOR MEDICAL EMERGENCIES | |
| CREDIT CARD PAYMENT | |
| OTHER | |
| OTHER | |
| OTHER | |
| TOTAL | |

| RECREATION/EDUCATION | |
|---|---|
| FUN NIGHT WITH FAMILY | |
| ENTERTAINMENT | |
| SPORTS EVENTS/EQUIP. | |
| MOVIES/PLAYS | |
| EXTRA FOOD | |
| HOBBIES | |
| SAVINGS FOR VACATION | |
| TUITION/BOOKS | |
| ROOM & BOARD | |
| EDUCATIONAL SUPPLIES | |
| SELF IMPROVEMENT | |
| SAVINGS FOR COLLEGE | |
| BOOKS/PAPER & MAGAZINES | |
| MEMBERSHIP DUES | |
| CREDIT CARD PAYMENT | |
| OTHER | |
| TOTAL | |

| CONTRIBUTIONS/MISC. | |
|---|---|
| CHURCH/SYNAGOGUE | |
| CHARITY | |
| POLITICAL | |
| TOBACCO/ALCOHOL | |
| GAMBLING | |
| PRESENTS/GIFTS | |
| BANK SERVICE CHARGE | |
| CREDIT CARD PAYMENT | |
| PERSONAL LOAN REPAYMENT | |
| OTHER | |
| OTHER | |
| OTHER | |
| OTHER | |
| OTHER | |
| TOTAL | |

FIGURE 7

THIS IS HOW YOU PLAN TO SPEND YOUR MONEY
WEEKLY PROJECTED SPENDING WORKSHEET

| WEEK | HOUSING CHILD CARE | FOOD | TRANS-PORTATION | CLOTHING PERS CARE | SAVINGS RETIREMENT | MEDICAL LIFE INS | RECREATION EDUCATION | CONTRI MISC |
|---|---|---|---|---|---|---|---|---|
| 1st WEEK | | | | | | | | |
| | | | | | | | | |
| | | | | | | | | |
| | | | | | | | | |
| WEEKLY PROJECTION | | | | | | | | |
| 2nd WEEK | | | | | | | | |
| | | | | | | | | |
| | | | | | | | | |
| | | | | | | | | |
| WEEKLY PROJECTION | | | | | | | | |
| 3rd WEEK | | | | | | | | |
| | | | | | | | | |
| | | | | | | | | |
| | | | | | | | | |
| WEEKLY PROJECTION | | | | | | | | |
| 4th & 5th WEEK | | | | | | | | |
| | | | | | | | | |
| | | | | | | | | |
| | | | | | | | | |
| | | | | | | | | |
| WEEKLY PROJECTION | | | | | | | | |
| MONTHLY PROJECTION | | | | | | | | |

HOUSEHOLD SPENDING RECORD

| MONTH OF _____ | | HOUSING & CHILD CARE | FOOD | TRANS. | CLOTHING & PERS. CARE | SAVINGS & RETIREMENT | MEDICAL & LIFE INS. | RECREATION & EDUCATION | CONTRI. & MISCELLANEOUS | COMBINED TOTALS | WEEK'S SPENDING DIFFERENTIAL | SPENDING DIFFERENTIAL TOTAL-TO-DATE |
|---|---|---|---|---|---|---|---|---|---|---|---|---|
| 1st WEEK | PROJECTED SPENDING | | | | | | | | | | (+) | ( ) |
| | ACTUAL SPENDING | | | | | | | | | | (–) | |
| 2nd WEEK | PROJECTED SPENDING | | | | | | | | | | (+) | ( ) |
| | ACTUAL SPENDING | | | | | | | | | | (–) | |
| 3rd WEEK | PROJECTED SPENDING | | | | | | | | | | (+) | ( ) |
| | ACTUAL SPENDING | | | | | | | | | | (–) | |
| 4th & 5th WEEK | PROJECTED SPENDING | | | | | | | | | | (+) | ( ) |
| | ACTUAL SPENDING | | | | | | | | | | (–) | |
| MONTHLY ACTUAL SPENDING | | | | | | | | | | | | |

FIGURE 8

THIS IS WHAT YOU DO WITH YOUR PAYCHECK BEFORE SPENDING.

EARMARKED FUNDS WORKSHEET

| WEEKS | NET INCOME | HOUSING/ CHILD CARE | FOOD | TRANS. | CLOTHING/ PERSONAL CARE | SAVINGS & RETIRE. | MED. & LIFE INS. | REC./ED. | CONTRI-BUTIONS & MISC. | COMBINED TOTALS |
|---|---|---|---|---|---|---|---|---|---|---|
| 1st. | | | | | | | | | | |
| 2nd. | | | | | | | | | | |
| 3rd. | | | | | | | | | | |
| 4th. & 5th. | | | | | | | | | | |
| TOTALS | | | | | | | | | | |

1st Week's Spending MONEY-TRACKER™ Month of_____

| DAYS | HOUSING AND CHILD CARE | FOOD | TRANSPORTATION | CLOTHING AND PERSONAL CARE | SAVINGS AND RETIREMENT | MEDICAL AND LIFE INSURANCE | RECREATION AND EDUCATION | CONTRIBUTIONS & MISCELLANEOUS | REMARKS / DAILY COMBINED TOTALS |
|---|---|---|---|---|---|---|---|---|---|
| 1 | | | | | | | | | TOTAL: |
| 2 | | | | | | | | | TOTAL: |
| 3 | | | | | | | | | TOTAL: |

| DAYS | HOUSING | FOOD | TRANS. | CLOTH. | SAV./RET. | MEDICAL | REC./ED. | MISC. | COMBINED TOTALS |
|---|---|---|---|---|---|---|---|---|---|
| 4 | | | | | | | | | TOTAL: |
| 5 | | | | | | | | | TOTAL: |
| 6 | | | | | | | | | TOTAL: |
| 7 | | | | | | | | | TOTAL: |
| SPENDING PRO-JECTED | | | | | | | | | |
| SPENDING ACTUAL | | | | | | | | | |

FIGURE 9

COMMENTS AND SUGGESTIONS ON LAST MONTH'S RESULTS

THIS MONTH'S OBJECTIVES AND GOALS

- *DEVELOP AN EFFECTIVE SPENDING PLAN*
- 
- 
- 
- 
- 
-

MONTHLY GRAND TOTALS

| | HOUSING/ CH. CARE | FOOD | TRANS. | CLOTH-ING | SAVINGS & RET. | MED. & LIFE INS. | REC./ ED. | CONT./ MISC. | COMBINED TOTALS |
|---|---|---|---|---|---|---|---|---|---|
| MONTHLY PROJECTED SPENDING | | | | | | | | | |
| MONTHLY ACTUAL SPENDING | | | | | | | | | |
| SPENDING DIFFEREN-TIAL + / - AMOUNT | | | | | | | | | |

MONTHLY NET INCOME

| | 1st WEEK | 2nd WEEK | 3rd WEEK | 4th & 5th WEEK |
|---|---|---|---|---|
| | SALARY | SALARY | SALARY | SALARY |
| | OTHER | OTHER | OTHER | OTHER |
| | TOTAL | TOTAL | TOTAL | TOTAL |

NET CASH FLOW + / - AMOUNT →

MONTHLY SUMMARY

| | |
|---|---|
| MONTHLY PROJECTED SPENDING | |
| NET INCOME | |
| TOTAL ACTUAL SPENDING | |
| NET INCOME MINUS SPENDING | |

FIGURE 10

HOUSEHOLD SPENDING RECORD

| MONTH OF _____ | | HOUSING & CHILD CARE | FOOD | TRANS. | CLOTHING & PERS. CARE | SAVINGS & RETIREMENT | MEDICAL & LIFE INS. | RECREATION & EDUCATION | CONTRI. & MISCELLANEOUS | COMBINED TOTALS | WEEK'S SPENDING DIFFERENTIAL | SPENDING DIFFERENTIAL TOTAL-TO-DATE |
|---|---|---|---|---|---|---|---|---|---|---|---|---|
| 1st WEEK | PROJECTED SPENDING | | | | | | | | | | (+) | ( ) |
| | ACTUAL SPENDING | | | | | | | | | | (–) | |
| 2nd WEEK | PROJECTED SPENDING | | | | | | | | | | (+) | ( ) |
| | ACTUAL SPENDING | | | | | | | | | | (–) | |
| 3rd WEEK | PROJECTED SPENDING | | | | | | | | | | (+) | ( ) |
| | ACTUAL SPENDING | | | | | | | | | | (–) | |
| 4th & 5th WEEK | PROJECTED SPENDING | | | | | | | | | | (+) | ( ) |
| | ACTUAL SPENDING | | | | | | | | | | (–) | |
| MONTHLY ACTUAL SPENDING | | | | | | | | | | | | |

MONTHLY GRAND TOTALS

| | HOUSING/ CH. CARE | FOOD | TRANS. | CLOTH-ING | SAVINGS & RET. | MED. & LIFE INS. | REC./ ED. | CONT./ MISC. | COMBINED TOTALS |
|---|---|---|---|---|---|---|---|---|---|
| MONTHLY PROJECTED SPENDING | | | | | | | | | |
| MONTHLY ACTUAL SPENDING | | | | | | | | | |
| SPENDING DIFFERENTIAL + / - AMOUNT | | | | | | | | | |

| MONTHLY NET INCOME | 1st WEEK | 2nd WEEK | 3rd WEEK | 4th & 5th WEEK |
|---|---|---|---|---|
| | SALARY | SALARY | SALARY | SALARY |
| | OTHER | OTHER | OTHER | OTHER |
| | TOTAL | TOTAL | TOTAL | TOTAL |
| | NET CASH FLOW + / - AMOUNT → | | | |

| MONTHLY SUMMARY | |
|---|---|
| MONTHLY PROJECTED SPENDING | |
| NET INCOME | |
| TOTAL ACTUAL SPENDING | |
| NET INCOME MINUS SPENDING | |

FIGURE 11

SEMI-ANNUAL FINANCIAL PROGRESS REPORT

| SPENDING CATEGORY | RECOM-MENDED SPENDING PERCENT * | MONTHLY PROJECTED SPENDING AMOUNT $ | MONTH OF NET INCOME / ACTUAL SPENDING | MONTH OF NET INCOME / ACTUAL SPENDING | MONTH OF NET INCOME / ACTUAL SPENDING | MONTH OF NET INCOME / ACTUAL SPENDING | MONTH OF NET INCOME / ACTUAL SPENDING | MONTH OF NET INCOME / ACTUAL SPENDING | SIX MONTH AVERAGE NET INCOME / ACTUAL SPENDING | SIX MTH. AVG. % |
|---|---|---|---|---|---|---|---|---|---|---|
| HOUSING/ CHILD CARE | 24 - 42 % | | | | | | | | | |
| FOOD | 12 - 24 % | | | | | | | | | |
| TRANSPOR-TATION | 8 - 18 % | | | | | | | | | |
| CLOTHING & PERSONAL | 8 - 18 % | | | | | | | | | |
| SAVINGS/ RETIREMENT | 5 - 20 % | | | | | | | | | |
| MEDICAL/LIFE INSURANCE | 6 - 12 % | | | | | | | | | |
| RECREATION & EDUCATION | 8 - 16 % | | | | | | | | | |
| CONTRI. & MISC. | 5 - 12 % | | | | | | | | | |
| MONTHLY ACTUAL SPENDING | | | | | | | | | | |
| NET CASH FLOW + OR - AMOUNT | | | | | | | | | | |

*Your PERCENTAGE is determined by dividing ACTUAL SPENDING by NET INCOME and multiplying by 100. The RECOMMENDED PERCENTAGES are to be used only as a guideline. Each category may vary depending on each individual circumstance. SEE AUTHOR'S NOTES.

THE IMPACT OF DEFICIT SPENDING

A CONSEQUENCE OF DEFICIT SPENDING IS THE REDUCTION OR TOTAL ELIMINATION OF FUTURE PERSONAL PURCHASING POWER. YOU GET OUT OF DEBT BY CONTROLLING SPENDING. WHEN SPENDING EXCEEDS INCOME A DEFICIT WILL RESULT. WHEN A DEFICIT OCCURS, IT MUST BE COVERED BY BORROWING OR BY REDUCING SAVINGS.

Borrowing money for spending is called deficit spending which is spending beyond income limits. The most common form of deficit spending occurs with the credit card. A major portion of the payment you make each month on a credit card debt is an interest payment. Interest is the price you pay for deficit spending. It is the cost of using other people's money. For instance, if you maintained a $3000.00 balance all year on your credit card with an interest rate of 18% A.P.R., it would cost you approximately $45.00 a month for using other people's money. Can you afford to waste large amounts of money each month on interest charges? Can you afford to give up personal purchasing power in order to pay interest? Can you imagine the power of what that much money per month would do if you were putting that money into an investment program or into the development of your own business? It is important for you to know how much it is costing you each month to use other people's money for your deficit spending. That payment does not reduce the debt you owe, it only allows you to keep the debt. You need to make a payment in excess of the interest to reduce the debt.

FIGURE 12

DEBT REDUCTION WORKSHEET

Date _____

| TYPE LOAN | CREDITORS | APR | REMAINING BALANCE | AVERAGE MONTHLY PAYMENT | AMOUNT TOWARD INTEREST | AMOUNT TOWARD PRINCIPAL | MONTHS LEFT TO PAY | AMOUNT EXTRA |
|---|---|---|---|---|---|---|---|---|
| HOME | | | | | | | | |
| HOME | | | | | | | | |
| AUTOMOBILE | | | | | | | | |
| AUTOMOBILE | | | | | | | | |
| | | | | | | | | |
| EDUCATION | | | | | | | | |
| | | | | | | | | |
| | | | | | | | | |
| INSTALLMENTS | | | | | | | | |
| | | | | | | | | |
| | | | | | | | | |

| TYPE LOAN | CREDITORS | APR | REMAINING BALANCE | AVERAGE MONTHLY PAYMENT | AMOUNT TOWARD INTEREST | AMOUNT TOWARD PRINCIPAL | MONTHS LEFT TO PAY | AMOUNT EXTRA |
|---|---|---|---|---|---|---|---|---|
| INSTALLMENTS | | | | | | | | |
| | | | | | | | | |
| | | | | | | | | |
| | | | | | | | | |
| | | | | | | | | |
| | | | | | | | | |
| CREDIT CARDS | | | | | | | | |
| | | | | | | | | |
| | | | | | | | | |
| | | | | | | | | |
| | | | | | | | | |
| | | | | | | | | |

| TYPE LOAN | CREDITORS | APR | REMAINING BALANCE | AVERAGE MONTHLY PAYMENT | AMOUNT TOWARD INTEREST | AMOUNT TOWARD PRINCIPAL | MONTHS LEFT TO PAY | AMOUNT EXTRA |
|---|---|---|---|---|---|---|---|---|
| CREDIT CARDS | | | | | | | | |
| | | | | | | | | |
| | | | | | | | | |
| OTHER | | | | | | | | |
| | | | | | | | | |
| | | | | | | | | |
| | | | | | | | | |
| | TOTAL DEBT OBLIGATIONS | | | | | TOTAL AMOUNT ABOVE REGULAR PAYMENTS | | |

List all debts with highest A.P.R. (Interest Rate) to lowest. Determine Debt Ratio by dividing total monthly debt obligation by gross income and multiplying by 100. If debt ratio is over 35%, you have about as much financial obligations as you can afford. Take every dollar you can spare from your spending plan and add to your debt payment with the highest APR or to the debt with the lowest remaining balance. Make a personal commitment to establish no new debt and to get on a cash basis or to do without.

FIGURE 13

TAX-TRAC™ TAX DEDUCTIBLE RECORDS

| DATE | CHECK NO | CHARITY DONATIONS | MEDICAL & DENTAL | REAL ESTATE TAXES | PERSONAL PROPERTY TAX | JOB EXPENSES | INTEREST PAID | INVESTMENT INTEREST | CHILD CARE |
|---|---|---|---|---|---|---|---|---|---|
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |

| DATE | CHECK NO | CHARITY DONATIONS | MEDICAL & DENTAL | REAL ESTATE TAXES | PERSONAL PROPERTY TAX | JOB EXPENSES | INTEREST PAID | INVESTMENT INTEREST | CHILD CARE |
|---|---|---|---|---|---|---|---|---|---|
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| TOTALS | | | | | | | | | |

FIGURE 14

POCKET-SIZE PERSONAL FINANCIAL ORGANIZER

BACKGROUND AND SUMMARY OF THE INVENTION

This invention relates to financial organizing systems in general and to a personal, portable financial organizing system in particular for use by an individual who desires to monitor, control, and reduce personal spending on a daily basis for an extended period of time.

In addition to providing a convenient portable means for accurately projecting spending in various categories by month and by week, for recording daily, weekly, and monthly spending by spending category, and determining how much income to set aside for future spending, this invention also provides means for determining the differential between projected spending and actual spending per category by week and by month and for determining monthly cash flow. Furthermore, the invention provides a semi-annual financial progress report on total actual spending per month per category and on cash flow, a means for recording debt payments, and a means for recording tax deductible spending.

For many individuals, successful control of personal spending on a monthly or yearly basis requires successful control of personal spending on a daily basis. In the present invention, detailed analysis of daily spending on a weekly and monthly basis leads to an understanding of problem areas of spending and suggests ways to correct the spending problem. This can be accomplished by evaluation of weekly and monthly differentials between projected spending and actual spending and their relation to monthly cash flow. It is then possible to adjust discrete areas of spending to create positive spending differentials and positive cash flow, i.e., to make actual spending less than projected spending and to make actual spending less than net income.

A preferred embodiment of the invention contains a trifold cover with an inner lining that provides insertions for a check book, a check register, cards, and a unique personal financial organizer for monitoring, controlling, and reducing spending. With the personal financial organizer a user records on one set of pages, referred to as a Systematic Bill Payment Organizer, fixed bills that are due at regular intervals and determines from another set of pages, referred to as a Category Descriptions, which contain suggested spending categories, those categories that apply to the user. With this information a user makes an initial entry of monthly income and monthly projected spending amounts on designated pages, referred to as a Trac-A-Spending-Plan TM Worksheet, and, thereafter, enters initial weekly projected spending amounts on designated pages, referred to as a Weekly Projected Spending Worksheet. Monthly projected spending amounts are then transferred to a financial analysis page called Monthly Grand Totals. Weekly and monthly net incomes are also recorded on the Monthly Grand Totals. Weekly projected spending amounts are then transferred to a financial analysis page called Household Spending Record. Weekly projected spending amounts are also transferred to a daily spending record referred to as a Money-Tracker TM. The user then sets aside certain amounts of income for future spending and enters these amounts on designated pages, referred to as an Earmarked Funds Worksheet.

At this point the user is ready to record daily spending on the Money-Tracker TM. At the end of a week, total weekly actual spending per category and total weekly actual spending are calculated and these amounts are transferred to the Household Spending Record. The difference between projected spending per week and total weekly actual spending is calculated. This amount is referred to as a weekly spending differential. With this information the user can modify weekly projected spending and/or the amount of income to be set aside for future spending in order to keep the weekly spending differential positive. This process is repeated until one month is completed.

At the end of one month, a user calculates total monthly actual spending per category on the Household Spending Record. These amounts are transferred to the Monthly Grand Totals. A monthly spending differential per category and total monthly spending differential are calculated. Net cash flow, i.e., the difference between monthly net income and monthly actual spending, is calculated. This information is used to make adjustments in monthly and weekly projected spending in order to keep the monthly spending differential and cash flow positive. This process is repeated for a total of six months.

The user then prepares a semi-annual financial report on financial analysis pages referred to as a Semi-annual Financial Progress Report. Monthly net income, monthly projected spending per category, and monthly actual spending per category are transferred from six consecutive Monthly Grand Totals to the Semi-annual Financial Progress Report. Average six month actual spending per category, average six month actual spending per category as percent of average six-month monthly income, total monthly actual spending, monthly cash flow, average six month total monthly actual spending and six month average monthly cash flow are calculated. This information is used to further refine monthly projected spending, weekly projected spending, and daily spending to keep spending differentials and cash flows positive.

Two additional mechanisms are included in the personal financial organizer to help maintain cash flow positive. One is a Debt Reduction Worksheet on which a user records all debt and interest obligations and a payment schedule to reduce interest spending as rapidly as possible. This worksheet alerts the user to debt accumulation and helps curb debt accumulation such as credit card spending. The other is a tax deductible record, referred to as Tax-Trac TM on which a user records tax deductible spending as it occurs to facilitate a reduction in taxable income at the end of the year.

At present, most individuals carry a check book and check register and record spending by check. It is also possible to carry a booklet that records monthly income, budget amounts, and budget balance amounts. However, these types of booklets do not provide therein any financial analysis or financial summaries. It is necessary to go to other separate workbooks to calculate useful information such as spending differentials or cash flow.

The present invention was uniquely conceived and structured so that it contains financial recording and financial analysis components covering periods up to 12 months, all within a convenient portable booklet that can be carried in a pocket of clothing or in a purse. Furthermore, the invention provides means for an iterative or cycling process among monthly projected spending, weekly projected spending, daily actual spending, weekly actual spending, and monthly actual spending, facilitated by weekly, monthly, and semi-annual financial analyses, to make spending adjustments in order to maintain spending differentials and cash flows positive. It has not been possible until the present invention to have a pocket-size, self-contained, personal financial organizer that can be used up to twelve months to monitor, control, and reduce spending by this process.

BRIEF DESCRIPTION OF THE DRAWINGS

The details and advantages of this invention will become more apparent in the specifications, descriptions and drawings, of which:

FIG. 6 illustrates the Category Descriptions and the income portion of the Trac-A-Spending-Plan TM Worksheet;

FIG. 7 illustrates the monthly projected spending portion of the Trac-A-Spending- Plan TM Worksheet;

FIG. 8 illustrates the Weekly Projected Spending Worksheet and Household Spending Record;

FIG. 9 illustrates the Earmarked Funds Worksheet and the Money-Tracker TM;

FIG. 10 illustrates the Monthly Grand Totals and a page for monthly notes;

FIG. 11 demonstrates the Household Spending Record folded over the Money-Tracker TM pages so that it is adjacent to the Monthly Grand totals;

FIG. 12 illustrates the Semi-annual Financial Progress Report;

FIG. 13 illustrates the Debt Reduction Worksheet; and

FIG. 14 illustrates the Tax-Trac TM.

DETAILED DESCRIPTION OF THE PREFERRED EMBODIMENT

Figure 1:
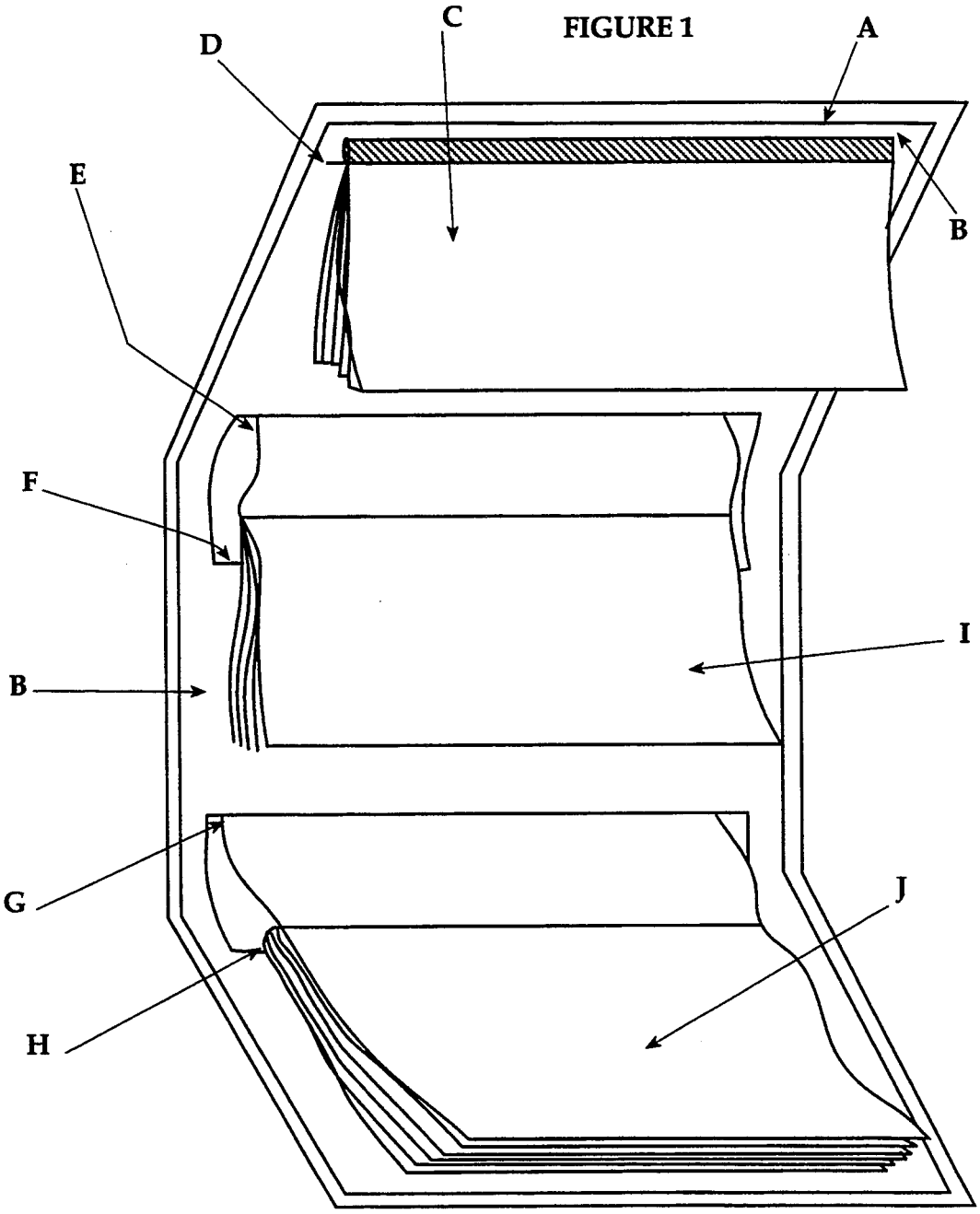
FIG. 1 is a perspective view of the inner side of the cover of the invention showing a checkbook, a checkbook register, and the personal financial organizer of the invention, contained within openings in the inner lining of the cover.

FIG. 1 is a perspective view of the cover of the personal, portable, financial organizing apparatus showing the inside of the cover (A); an inner lining (B) having a plurality of openings with the inner lining attached to the inside of the cover; a checkbook having covers (C) with one of said covers inserted in an opening (D) in the inner lining, a checkbook register having covers (I) with said covers inserted in openings (E and F) in the inner lining; a personal financial organizer having covers (J) with said covers inserted in openings (G and H) in the inner lining.

Figure 2:
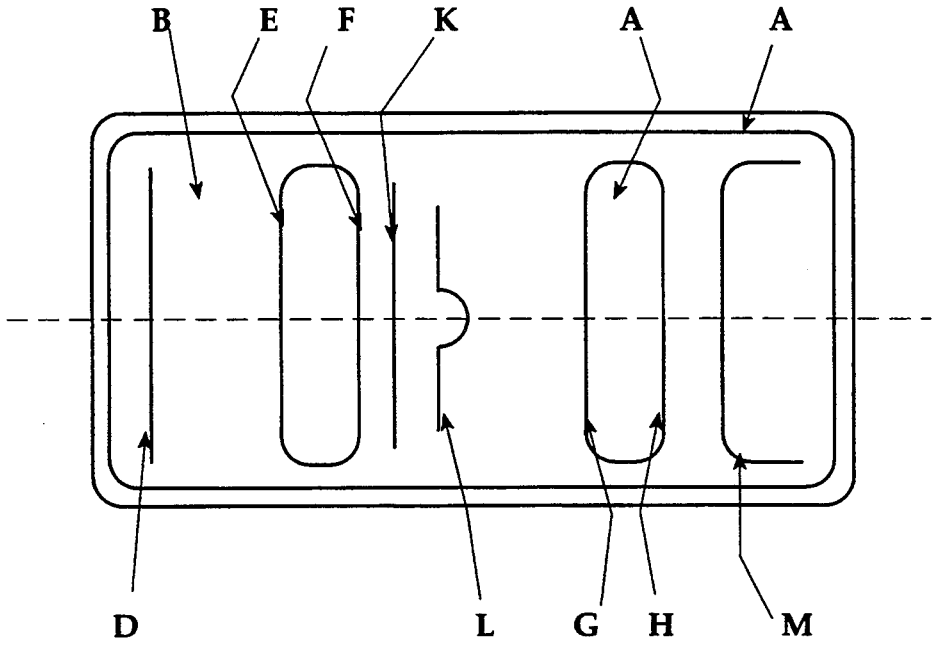
FIG. 2 is a plan view of the inner side of the cover showing openings in the inner lining.

FIG. 2 is a plan view of the inside of the cover (A) of the personal, portable financial organizing apparatus showing the inner lining (B) containing various openings for: a checkbook cover (D), checkbook register covers (E and F), documents (K), credit cards (L), personal financial organizer book covers (G and H), and accessing the back cover of the personal financial organizer (M).

Figure 3:
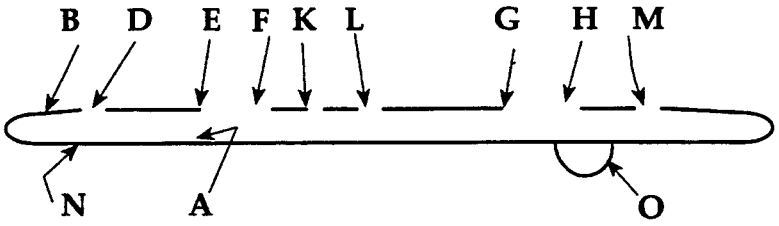
FIG. 3 is a cross sectional view through the plan view of the cover shown in FIG. 2.

FIG. 3 is a cross sectional view of the cover as shown in FIG. 2 taken through the portion indicated by the dotted line. The outside of the cover (N) contains a circular loop to hold a pen, pencil, or similar object.

Figure 4:
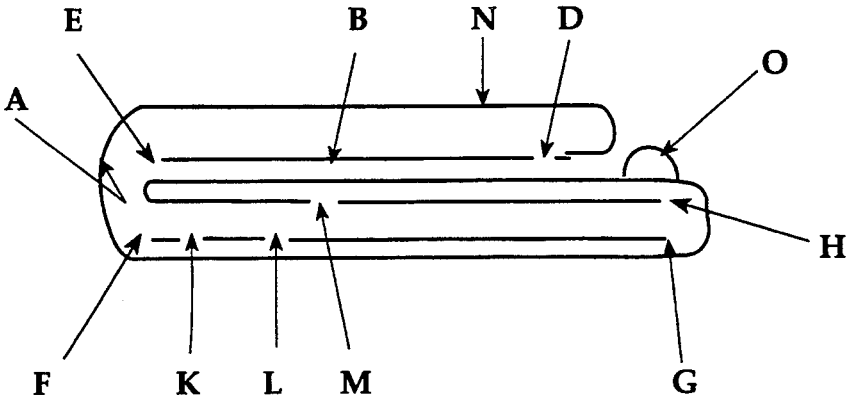
FIG. 4 illustrates the cover in a trifold configuration suitable for insertion in a pocket or purse.

FIG. 4 shows the cover as depicted in FIG. 3 in a trifold position with a right portion folded over a middle portion and a left portion folded over the right portion so that the apparatus may fit conveniently in a pocket of clothing or a purse.

The cover can be constructed of any durable, flexible material, preferably plastic. The size of the cover is 4 to 8 inches in length and 2 to 4 inches in width, preferably $6\frac{1}{4}$ inches long and $3\frac{1}{2}$ inches wide.

The personal financial organizer is composed of front and back covers with several pages in between, bound at the center by common binding means, preferably a coiled metal wire inserted through perforations in the cover and pages. The covers are made of a suitable stiff paper that contain and protect the pages within and that can be inserted into the openings of the plastic cover of the personal portable financial organizing apparatus. The pages of the personal financial organizer contain several forms which provide a mechanism to monitor, control, and reduce spending.

Figure 5:
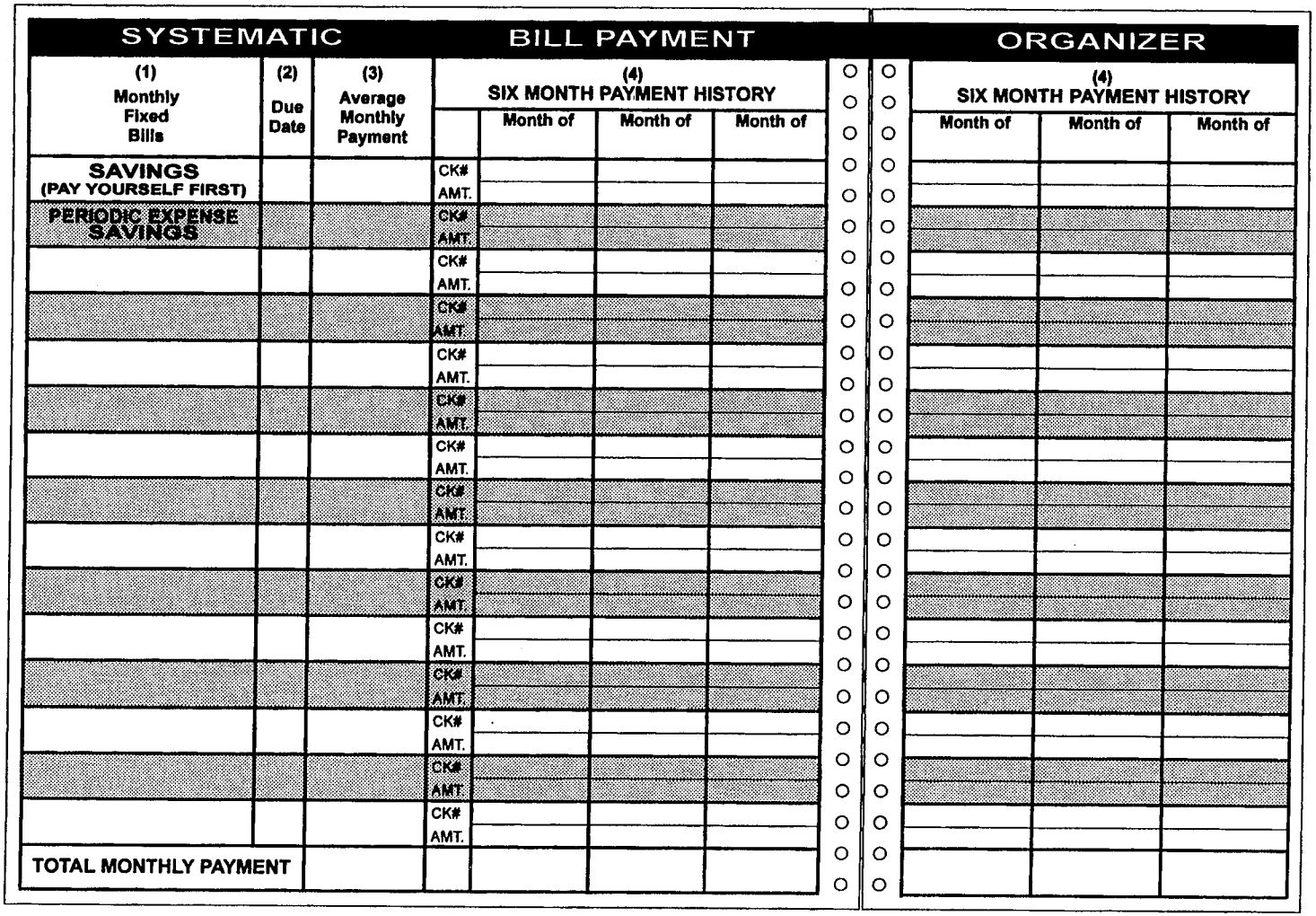
FIG. 5 illustrates the Systematic Bill Payment Organizer.

FIG. 5 shows the Systematic Bill Payment Organizer on the first and second pages of the personal financial organizer. The first page has an extension which forms a left portion, the first page a middle portion, and the second page a right portion of the Systematic Bill Payment Organizer. The Systematic Bill Payment Organizer contains horizontal and vertical lines forming rows, columns, and discrete rectangles for data entry. The columns are labeled monthly fixed bills, due date, average monthly payment, and six month payment history. The Systematic Bill Payment Organizer is used to list payments which are fixed and regular such as rent, mortgage payment, insurance premiums, car payments, savings, etc.. The nature of the expense, the due date, the average monthly payment, and the check number and amount are recorded. This process allows a user to save money from a paycheck or other source of income to use for paying fixed bills and to follow the history of these payments.

FIG. 6 shows the Category Descriptions on the third and fourth pages of the personal financial organizer. The Trac-A-Spending-Plan TM (source of income) worksheet is on an extension of the fourth page. The Category Descriptions contains horizontal and vertical lines forming columns, rows, and discrete rectangles for entering data. The columns are labeled housing/child care, food, transportation, clothing/personal care, savings/retirement, medical/life insurance, recreation-/education, and contributions/miscellaneous. Under each heading are listed various categories of spending. The Category Descriptions serves as a reference guide that a user can study to identify his or her spending categories and can enter specific spending categories not listed.

After having entered information on the Systematic Bill Payment Organizer and studied the Category Descriptions, a user proceeds to the Trac-A-Spending-Plan TM (source of income) Worksheet. This worksheet contains horizontal and vertical lines forming columns, rows, and discrete rectangles for entering data. Columns are labeled income deductions, income, interest income, miscellaneous income, and totals. Rows are labeled monthly gross income, less tithes, less withholding taxes, and monthly net income. This worksheet is used to compute the total monthly net income available for spending.

The Trac-A-Spending-Plan TM (monthly projected spending) worksheet is continued on the fifth and sixth pages, with the fifth page having an extension such that the extension forms a left portion the fifth page a middle portion, and the sixth page a right portion of the worksheet (FIG. 7). This worksheet contains horizontal and vertical lines forming columns, rows, and discrete rectangles for entering data. The columns are labeled with the various spending categories as in the Category Descriptions (FIG. 6). Rows are labeled combined projected spending and net income. A user enters each projected spending amount for each applicable item within each spending category. The user then determines the total projected spending for each category. These totals are listed at the bottom of each column. The totals are added and the combined total is entered in the row labeled combined projected spending. Monthly net income is entered in the row labeled net income. Combined projected spending should not exceed monthly net income.

The user then proceeds to the Weekly Projected Spending Worksheet on the seventh and eighth pages (FIG. 8). This worksheet contains horizontal and vertical lines forming columns, rows, and discrete rectangles for entering data. The columns are labeled with the various spending categories as described in the Categories Descriptions. The rows are labeled first week, second week, third week, fourth and fifth week, weekly projection, and monthly projection. The user determines the amount of projected spending in each category for each week of the month. The amount of the projected spending for each category for each week is entered in the rows labeled weekly projection. The total amount of projected spending for each category for the month is entered in the row labeled monthly projection. These monthly totals should correspond to those on the Trac-A-Spending-Plan TM worksheet (FIG. 7).

At this point the user has evaluated and determined what amounts of income will be spent in specific categories in a given week for a month. The user then proceeds to the Earmarked Funds Worksheet which is formed by an extension of the ninth page (FIG. 9). This worksheet contains horizontal and vertical lines forming columns, rows, and discrete rectangles for entering data. The columns are labeled with the various spending categories, net income, and weeks. The rows are labeled first week, second week, third week, fourth and fifth week, and totals. The user determines how much of monthly income must be set aside for future spending in a given category for a given week. These amounts are entered in the appropriate row and column. The amounts in each column are added to determine total monthly net income and what portion of monthly net income must be set aside for a given spending category for a month.

The various totals of income and projected spending for a month or a week are transferred to other pages for analytical processing. One of these is the Household Spending Record which is formed as an extension of the eighth page (FIG. 8). This record contains horizontal and vertical lines forming columns, rows, and discrete rectangles for entering data. The columns are labeled month of, combined total, week's spending differential, spending differential total-to-date, and with the various spending categories. The rows are labeled first week projected spending/actual spending, second week projected spending/actual spending, third week projected spending/actual spending, fourth and fifth week projected spending/actual spending, and monthly actual spending. The first entries made on this record are projected spending amounts for each spending category for each week, transferred from the Weekly Projected Spending Worksheet.

Another page for analytical processing is the Monthly Grand Totals which is located on the eighteenth page (FIG. 10). The Monthly Grand Totals contains horizontal and vertical lines forming columns, rows, and discrete rectangles for entering data. The columns are labeled with the various spending categories, combined totals, first week, second week, third week, and fourth and fifth week. The rows are labeled monthly projected spending, monthly actual spending, spending differential, monthly net income, salary, other, total, monthly summary, monthly projected spending, net income, total actual spending, and net cash flow. The first entries on the Monthly Grand Totals are the monthly projected spending amounts and net income amounts, transferred from the Trac-A-Spending-Plan TM worksheet. Monthly net income may be entered by weekly amounts.

With these initial entries on the Household Spending Record and the Monthly Grand Totals the user is ready to record and monitor daily actual spending on the Money-Tracker TM (FIG. 9). The Money-Tracker TM contains horizontal and vertical lines forming columns, rows, and discrete rectangles for entering data. The columns are labeled with the various spending categories, days, and remarks/daily combined totals. The rows are labeled 1, 2, 3, 4, 5, 6, 7, projected sending, and actual spending on the ninth and tenth pages. The rows are labeled 8, 9, 10, 11, 12, 13, 14, projected sending, and actual spending on the eleventh and twelfth pages (not shown). The rows are labeled 15, 16, 17, 18, 19, 20, 21, projected sending, and actual spending on the thirteenth and fourteenth pages (not shown). The rows are labeled 22, 23, 24, 25, 26, 27, 28, 29, 30/31, projected sending, and actual spending on the fifteenth and sixteenth pages (not shown). Thus, the Money-Tracker TM is composed of eight pages with a row for each day of the month. A user can record the amount of each instance of spending each day within a specific category for each week of a month. At the end of each day the user calculates and enters the total spending amount for the day. Projected spending amounts per week per category are also recorded on the Money-Tracker TM, transferred from the Weekly Projected Spending Worksheet. At the end of each week total weekly actual spending per category and total weekly actual spending are calculated and these amounts are transferred to the Household Spending Record.

On the Household Spending record the difference between projected spending and actual spending is calculated for each category for a given week. The differences are added for each category to give a week's spending differential which is then recorded. If actual spending exceeded projected spending the differential will be negative. If the week's spending differential is negative the user can determine which category or categories of spending are contributing to excessive spending by comparing actual and projected spending for each category. Adjustments can then be made on the Weekly Projected Spending Worksheet to reduce projected spending in precise and discrete areas and on the Earmarked Funds Worksheet to set aside greater amounts of income for future spending. In this way the user can identify problem spending areas and make corrections in projected spending and then in actual spending to keep the spending differential positive. This process is repeated each week until the end of the month. The second, third, and fourth week's spending differentials are added to the first week's to give a spending differential total-to-date. At the end of the month monthly actual spending is recorded for each spending category.

The personal financial organizer is so constructed that the extension that forms the Household Spending Record on the eighth page folds over the ninth through seventeenth pages (comprising the Money-Tracker TM for a month). Once it is thus folded over, it is adjacent to the Monthly Grand Totals, thereby facilitating the transfer of information to the Monthly Grand Totals and the comparison of weekly and monthly analyses (FIG. 11). At the end of the month, monthly actual spending amounts for each spending category are copied from the Household Spending Record onto the Monthly Grand Totals. The difference between monthly projected spending and monthly actual spending is calculated for each spending category and recorded as a monthly spending differential. If actual spending is greater than projected spending the differential will be negative. Monthly total actual spending is subtracted from monthly net income to give net cash flow. If monthly total actual spending is greater than monthly net income, net cash flow will be negative. If the month's spending differentials are negative the user can determine which category or categories of spending are contributing to excessive spending by comparing actual and projected spending for each category. Adjustments can then be made on the Trac-A-Spending-Plan TM worksheet and the Weekly Projected Spending Worksheet to reduce projected spending in discrete and precise areas. Likewise, adjustments can be made on the Earmarked Funds Worksheet to set aside greater amounts of income for future spending needs. In this way the user can identify problem spending areas and make corrections in projected spending and then in actual spending to keep the spending differential positive. In turn, this will lead to a positive cash flow. This process is repeated each month for a total of six months.

At the end of six months a user completes the Semi-annual Financial Progress Report on the nineteenth and twentieth pages (FIG. 12). The Semi-annual Financial Progress report contains horizontal and vertical lines forming columns, rows, and discrete rectangles for entering data. The columns are labeled spending category, recommended spending percent, monthly projected spending amount, month of, net income, actual spending, six month average, and six month average spending percent. The rows are labeled with the various spending categories, monthly actual spending, and net cash flow +or −amount. The following amounts are transferred to this report: monthly projected spending per category, net income for each month, and actual spending per category for each month. Monthly actual spending is calculated by adding actual spending in each category. Monthly net cash flow is calculated by subtracting monthly actual spending from monthly net income. The six month average net income is obtained by adding the net incomes for each of the six months and dividing by 6. The six month average monthly actual spending is obtained by adding the monthly actual spending amounts for each of the six months and dividing by 6. The six month average net cash flow amount is obtained by adding the net cash flow amounts for each of the six months and dividing by 6. The six month average actual spending per category is obtained by adding the actual spending amounts in the category for each of the six months and dividing by 6. The six month average spending percent per category is obtained by dividing the six month average actual spending per category by the six month average income. The total six month average spending percent is obtained by dividing the total six month average actual spending by the six month average income.

With the Semi-annual Financial Progress Report completed, the user can compare six month average actual spending with monthly projected spending in each category, six month average spending percents with recommended spending percents, and determine whether cash flow is increasing with time as a result of adequate control of spending. As before, the user can then make adjustments on the Trac-A-Spending-Plan TM worksheet and the Weekly Projected Spending Worksheet to reduce projected spending in discrete and precise areas and make adjustments on the Earmarked Funds Worksheet to set aside greater amounts of income for future spending needs. The user can further identify problem spending areas and make corrections in projected spending and then in actual spending to keep the spending differential and cash flow positive. This process is repeated for another six month period as described above using additional pages for the Money-Tracker TM, Household Spending Record, Monthly Grand Totals, and Semiannual Financial Progress Report that are contained in the personal financial organizer. Thus, the personal financial organizer is a fully integrated device that can be used to monitor, control, and reduce spending for a period up to one year.

The Debt Reduction Worksheet (FIG. 13) helps the user reduce the amount of money he or she owes. The Debt Reduction Worksheet contains horizontal and vertical lines forming columns, rows, and discrete rectangles for entering data. The columns are labeled type loan, creditors, APR%, remaining balance, average monthly payment, amount toward interest, amount toward principal, months left to pay, and amount extra. The rows are labeled total debt obligation and total amount above regular payments. Borrowing money for spending is called deficit spending which is often spending beyond income limits. The most common form of deficit spending occurs with the credit card. An important aspect of reducing debt is to reduce deficit spending. A user lists all debts on the Debt Reduction Worksheet. A debt ratio is determined by dividing the total monthly debt obligation by gross income. The ratio should not exceed 35% of gross income. The user then determines from the various analytical worksheets the amount of retained income available from reduced spending that can be applied as an extra amount to reduce debt.

The Tax-Trac TM is used to record spending that is tax deductible so that at the end of the year the user has a complete record of tax deductible spending that will facilitate income tax preparation and reduce tax liability (FIG. 14). The Tax-Trac TM contains horizontal and vertical lines forming columns, rows, and discrete rectangles for entering data. The columns are labeled date, check number, charity donations, medical & dental, real estate taxes, personal property tax, job expenses, interest paid, investment interest, and child care. A row is labeled totals.

There has been shown and described in detail preferred embodiments of this invention. However, it is apparent to one skilled in the art that this invention may incorporate other embodiments in many different forms. The present disclosure serves as an exemplification of the principles of the invention and is not intended to limit the invention to the embodiment illustrated. The scope of the invention is described in the appended claims.

What is claimed is:

1. An apparatus for monitoring, controlling, and reducing spending referred to as a personal financial organizer, having a plurality of pages connected by a binding means, said personal financial organizer thereby having pages on a left side and a right side of said binding means, said pages containing parallel horizontal and vertical lines forming columns, rows, and discrete rectangular areas for entering data wherein (a) first and second pages comprise means for organizing monthly fixed bills, referred to as a Systematic Bill Payment Organizer having columns labeled monthly fixed bills, due date, average monthly payment, and six month payment history and rows labeled savings, periodic expense savings, total monthly payments and check number/amount, said first page having an extension so that the extension forms a left portion, the first page a middle portion, and the second page a right portion of said Systematic Bill Payment Organizer;

(b) third and fourth pages comprise means for listing spending categories, referred to as a Category Descriptions having columns labeled with spending categories including housing/child care, food, transportation, clothing/personal care, savings/retirement, medical/life insurance, recreation/education, and contribution/miscellaneous and comprise means for recording monthly projected spending per category for comparison to monthly net income, referred to as a Trac-A-Spending-Plan TM Worksheet having columns labeled income deductions, income, interest income, miscellaneous income, and totals and rows labeled monthly gross income, less tithes, less withholding taxes, and monthly net income, said fourth page having an extension so that said third page forms a left portion and said fourth page forms a right portion of said Category Descriptions and said extension forms said Trac-A-Spending-Plan TM Worksheet;

(c) fifth and sixth pages comprise said Trac-A-Spending-Plan TM Worksheet having columns labeled with monthly projected spending and said spending categories, said fifth page having an extension so that said extension forms a left portion, said fifth page forms a middle portion and said sixth page forms a right portion of said Trac-A-Spending-Plan TM Worksheet;

(d) seventh and eighth pages comprise means for recording projected spending per category per week, referred to as a Weekly Projected Spending Worksheet having columns labeled with said spending categories and rows labeled first week, second week, third week, and fourth and fifth week and comprise means for recording actual spending per category by week for comparison to weekly projected spending per category, calculating a total weekly spending differential, calculating a total-to-date spending differential balance, and calculating monthly actual spending per category, referred to as a Household Spending Record having columns labeled with said categories, combined totals, week's spending differential, and spending differential total-to-date and rows labeled first week projected spending/actual spending, second week projected spending/actual spending, third week projected spending/actual spending, and fourth/fifth week projected spending/actual spending, said eighth page having an extension so that said seventh page forms a left portion and said eighth page forms a right portion of said Weekly Projected Spending Worksheet and said extension forms said Household Spending Record;

(e) ninth and tenth pages comprise means for determining how much income to set aside for future spending based upon prior spending by projecting spending per category per week and per month, referred to as an Earmarked Funds Worksheet having columns labeled with said categories, net income and combined totals and rows labeled first week, second week, third week, and fourth and fifth week, and comprise means for recording actual spending per category per day for each week of a month, weekly actual spending per category, weekly projected spending per category, total actual spending per day, total weekly projected spending, and total weekly actual spending, referred to as a Money-Tracker TM having columns labeled with said spending categories, remarks/daily combined totals, and days and rows labeled 1,2, 3, 4, 5, 6, 7, projected spending, and actual spending, said ninth page having an extension so that said ninth page forms a left portion and said tenth page forms a right portion of said Money-Tracker TM and said extension forms said Earmarked Funds Worksheet;

(f) eleventh, twelfth, thirteenth, fourteenth, fifteenth, and sixteenth pages comprise said Money-Tracker TM without said extension on the pages, said eleventh and twelfth pages having said rows labeled 8, 9, 10, 11, 12, 13, 14, said thirteenth and fourteenth pages having said rows labeled 15, 16, 17, 18, 19, 20, and 21, and said fifteenth and sixteenth pages having said rows labeled 22, 23, 24, 25, 26, 27, 28, 29, 30, and 31;

(g) a seventeenth page comprises a page for recording comments, suggestions, objectives and goals;

(h) an eighteenth page comprises means for recording monthly actual spending per category for comparison to monthly projected spending per category, recording monthly net income, calculating monthly spending differentials per category, total monthly projected spending, total monthly actual spending, total monthly spending differential, and calculating a month's cash flow, referred to as a Monthly Grand Totals having columns labeled with said spending categories, combined totals, first week, second week, third week, fourth and fifth week, and rows labeled monthly projected spending, monthly actual spending, spending differential, monthly net income, monthly summary, combined spending, and net cash flow amount;

(i) nineteenth and twentieth pages comprise means for creating a semi-annual financial progress report presenting recommended spending percents per category, monthly projected spending per category, actual spending per month per category, net income per month, six month average net income, six month average actual spending per category, six month average spending percents per category, total actual spending per month, cash flow per month, six month average total actual spending per month, and six month average cash flow per month, referred to as a Semi-annual Financial Progress Report having columns labeled spending category, recommended spending percents, monthly projected spending amount, monthly net income, monthly actual spending, six month average income, six month average spending, and six month average spending percent and rows labeled with said spending categories and recommended spending percents, monthly actual spending, and net cash flow so that said fifteenth page forms a left portion and said sixteenth page forms a right portion of said Semi-Annual Financial Progress Report;

(j) twenty-first and twenty-second pages comprise means for recording debt payments to determine total monthly debt obligations, to calculate, a debt ratio, and to determine extra amounts of payments to reduce debt, referred to as a Debt Reduction Worksheet having columns labeled type loan, creditors, APR%, remaining balance, average monthly payments, amount toward interest, amount toward principal, months left to pay, and amount extra and rows labeled home, automobile, education, installments, credit cards, and other, said twenty-first page having an extension so that the extension forms a left portion, the twenty-first page a middle portion, and the twenty-second page a right portion of said Debt Reduction Worksheet;

(k) twenty-third and twenty-fourth pages comprise means for recording tax deductible spending, referred to as a Tax-Trac TM having columns labeled date, check number, charity donations, medical and dental, real estate taxes, personal property tax, job expenses, interest paid, investment interest, child care and a row labeled totals;

(l) said extension of said eighth page forming said Household Spending Record folds over the eleventh through seventeenth pages thereby lying adjacent to said eighteenth page so that said Household Spending Record and said Monthly Grand Totals may be viewed together; and (m) said personal financial organizer has multiples of said Household Spending Record, Monthly Grand Totals, Money-Tracker TM, and Semi-annual Financial Progress Report so that said personal financial organizer may be used over a twelve month period, whereby a user monitors, controls, and reduces spending by (1) entering fixed bill amounts on said Systematic Bill Payment organizer;

(2) examining said Category Descriptions to determine applicable spending categories and entering categories that are unique for the user;

(3) completing said Trac-A-Spending-Plan TM Worksheet to determine monthly net income, monthly projected spending per category, total monthly projected spending, and the relationship of total monthly projected spending to monthly net income;

(4) completing said Weekly Projected Spending Worksheet to determine weekly projected spending per category;

(5) entering on said Monthly Grand Totals monthly spending amounts that are projected for each spending category and entering weekly income amount as it is paid;

(6) entering on said Household Spending Record weekly projected spending amounts per category and total combined weekly projected spending amounts;

(7) entering on said Earmarked Funds Worksheet the portions of a paycheck that will be set aside for future spending for a particular category during a particular week;

(8) entering on said Money-Tracker TM weekly projected spending amounts per category, total Weekly projected spending amount, actual spending amounts incurred during the week on a daily basis for each category, total actual spending amounts for the day, weekly actual spending amounts per category, and total actual weekly spending amounts;

(9) transferring weekly actual spending amounts per category from said Money-Tracker TM to said Household Spending Record, adding said weekly actual spending amounts per category to obtain monthly actual spending per category and total actual spending per week, and subtracting said total actual spending per week from total weekly projected spending to obtain said weekly spending differential;

(10) adding said spending differential to said spending differential total-to-date balance;

(11) using said spending differential to make adjustments in a next week's projected spending to maintain said spending differential balance positive and repeating this process for each week of a month until the end of said month;

(12) entering on said Household Spending Record total monthly actual spending amount;

(13) entering on said Monthly Grand Totals said monthly actual spending amount per category, total monthly actual spending amount, the monthly spending differential amount per category, total monthly spending differential amount, income amount per week, and total monthly income amount;

(14) calculating on said Monthly Grand Totals a net monthly cash flow by subtracting total monthly actual spending from total monthly income, then making adjustments on a next month's and week's projected spendings to make said cash flow positive for a next month, and repeating this process each month;

(15) entering on said Semi-annual Financial Progress Report, for each of six months, total monthly income amount, monthly actual spending amount per category, total monthly actual spending amount, and monthly cash flow amounts, calculating six month averages for income, actual spending per category, total monthly actual spending and cash flow, and calculating thereon six month spending percents by dividing six month average actual spending per category and total six month actual spending by average six month income;

(16) adjusting the next month's and week's projected spendings to increase cash flow;

(17) entering debt information on said Debt Reduction Worksheet to determine debt cost, debt ratio, how much payment can be made to increase the rate at which debt is reduced, and how debt spending can be reduced; and

(18) recording spending on said Tax-Trac TM to provide total annual tax deductible spending to reduce income tax liability.

* * * * *